US005342820A

United States Patent [19]

Defieuw et al.

[11] Patent Number: 5,342,820

[45] Date of Patent: Aug. 30, 1994

[54] DYE-DONOR ELEMENT FOR USE ACCORDING TO THERMAL DYE SUBLIMATION TRANSFER

[75] Inventors: Geert Defieuw, Kessel-Lo; Emiel Verdonck, Berlaar, both of Belgium

[73] Assignee: AGFA-Gevaert N.V., Mortsel, Belgium

[21] Appl. No.: 45,096

[22] Filed: Apr. 12, 1993

[30] Foreign Application Priority Data

Jun. 4, 1992 [EP] European Pat. Off. ..... 92201621.7

[51] Int. Cl.[5] ..... B41M 5/035; B41M 5/38

[52] U.S. Cl. ..... 503/227; 428/195; 428/327; 428/412; 428/500; 428/522; 428/913; 428/914

[58] Field of Search ..... 8/471; 428/195, 913, 428/914, 327, 412, 500, 522; 503/227

[56] References Cited

U.S. PATENT DOCUMENTS 5,229,352 7/1993 Beck et al. ..... 503/227

*Primary Examiner*—B. Hamilton Hess

*Attorney, Agent, or Firm*—Breiner & Breiner

[57] ABSTRACT

Dye-donor element for use according to thermal dye sublimation transfer comprising a support having on one side thereof a dye layer, characterized in that said dye layer or a layer adjacent to said dye layer contains a toluene sulfonamide formaldehyde condensation product.

11 Claims, No Drawings

DYE-DONOR ELEMENT FOR USE ACCORDING TO THERMAL DYE SUBLIMATION TRANSFER

DESCRIPTION

1. Field of the Invention

The present invention relates to a dye-donor element for use according to thermal dye sublimation transfer printing and more particularly to materials which can be added to the dye-donor element in order to improve the dye transfer efficiency.

2. Background of the Invention

Thermal dye sublimation transfer also called thermal dye diffusion transfer is a recording method in which a dye-donor element provided with a dye layer containing sublimable dyes having heat transferability is brought into contact with a receiver sheet and selectively, in accordance with a pattern information signal, heated with a thermal printing head provided with a plurality of juxtaposed heat-generating resistors, whereby dye from the selectively heated regions of the dye-donor element is transferred to the receiver sheet and forms a pattern thereon, the shape and density of which is in accordance with the pattern and intensity of heat applied to the dye-donor element.

A dye-donor element for use according to thermal dye sublimation transfer usually comprises a very thin support e.g. a polyester support, one side of which is covered with a dye layer, which contains the printing dyes. Usually an adhesive or subbing layer is provided between the support and the dye layer. Normally the opposite side is covered with a heat-resistant layer that provides a lubricated surface against which the thermal printing head can pass without suffering abrasion. An adhesive layer may be provided between the support and the heat-resistant layer.

The dye layer can be a monochrome dye layer or it may comprise sequential repeating areas of different colored dyes like e.g. of cyan, magenta, yellow and optionally black hue. When a dye-donor element containing three or more primary color dyes is used, a multicolor image can be obtained by sequentially performing the dye transfer process steps for each color.

It is always desirable to transfer as much dye as possible with the lowest thermal energy in said thermal dye sublimation transfer systems. The amount of dye which can be transferred from a dye-donor element to a receiving element by thermal dye transfer depends upon the dye transfer efficiency. It is known to add so-called thermal solvents to the dye-donor element in order to increase the dye transfer efficiency and thus to obtain enhanced dye transfer densities. Thermal solvents are non-hydrolyzable organic compounds that are solid at ambient temperature but molten at elevated temperatures. They have a melting point between 40° C. and 300° C., preferably between 40° C. and 150° C. In molten state they act as a solvent within the element in which they are contained. These compounds are known under such different names like thermal solvents, melt-formers, melt-modifiers, eutectic formers, plasticizers, softeners, and thermal development and diffusion-promoting agents.

Various classes of thermal solvents have been described for use in thermal dye transfer donor elements, for example, in EP 318944, EP 318945, EP 390044, JP 56/89985, JP 59/222391, JP 60/44392, JP 60/56590, JP 61/286199, JP 62/108086, JP 62/283176, JP 02/3384, JP 02/25387, JP 02/151485 and JP 03/10891 and in European Patent Application No. 91202308.2.

However, the use of thermal solvents in the dye layer of the dye-donor element decreases the stability of the dye-donor element stored in rolled form due to the transfer of these compounds of the dye layer of one wrapping of the donor element to the heat-resistant layer of an adjacent wrapping of the donor element or due to the softening of the dye layer.

Further said thermal solvents cause crystallization of the dyes.

SUMMARY OF THE INVENTION

Therefore it is an object of the present invention to provide an additive for incorporation in the dye-donor element not having the disadvantages mentioned above.

According to the present invention there is provided a dye-donor element for use according to thermal dye sublimation transfer comprising a support having on one side thereof a dye layer, characterized in that said dye layer or a layer adjacent to said dye layer contains a toluene sulfonamide formaldehyde condensation product.

Dye-donor elements containing a toluene sulfonamide formaldehyde condensation product according to the present invention provide an increase in dye transfer efficiency without affecting the stability of the dye-donor element stored in rolled form and without increasing the crystallization rate of the dye(s) in the dye layer.

DETAILED DESCRIPTION OF THE INVENTION

Commercially available toluene sulfonamide formaldehyde condensation products are e.g. Ketjenflex MH and Ketjenflex MS-80 (Akzo, The Netherlands). The use of the solid resin Ketjenflex MH is highly preferred. Products of this type are also described in EP 457458.

Preferably the toluene sulfonamide formaldehyde condensation product is contained in the dye layer itself.

Although dye layers comprising only these toluene sulfonamide formaldehyde condensation resins as polymeric binder can be used in thermal dye sublimation transfer, it is preferred to use another polymeric binder or binder mixture in addition to the toluene sulfonamide formaldehyde condensation product.

As polymeric binder the following can be used: cellulose derivatives, such as ethyl cellulose, hydroxyethyl cellulose, ethylhydroxy cellulose, ethylhydroxyethyl cellulose, hydroxypropyl cellulose, methyl cellulose, nitrocellulose, cellulose acetate formate, cellulose acetate hydrogen phthalate, cellulose acetate, cellulose acetate propionate, cellulose acetate butyrate, cellulose acetate pentanoate, cellulose acetate benzoate, cellulose triacetate; vinyl-type resins and derivatives, such as polyvinyl alcohol, polyvinyl acetate, polyvinyl butyral, copolyvinyl butyral-vinyl acetal-vinyl alcohol, polyvinyl pyrrolidone, polyvinyl acetoacetal, polyacrylamide; polymers and copolymers derived from acrylates and acrylate derivatives, such as polyacrylic acid, polymethyl methacrylate and styrene-acrylate copolymers; polyester resins; polycarbonates; poly(styrene-co-acrylonitrile); polysulfones; polyphenylene oxide; organosilicones, such as polysiloxanes; epoxy resins and natural resins, such as gum arabic. Preferably cellulose acetate butyrate, cellulose acetate propionate, polyvinylbutyral, polyvinylacetal, cellulose acetate and poly(styrene-co-acrylonitrile) are used as binder for the dye layer of the present invention. Poly(styrene-co-acrylonitrile) is highly preferred for use as a polymeric binder in combination with a toluene sulfonamide formaldehyde condensation product.

The ratio of polymeric binder to the toluene sulfonamide formaldehyde condensation product can be 0.1 to 100, preferably 0.5 to 20, most preferably 1 to 10.

The dye layer of the thermal dye sublimation transfer donor element according to the present invention is formed preferably by adding the dyes, the toluene sulfonamide formaldehyde condensation product, the polymeric binder and other optional components to a suitable solvent or solvent mixture, dissolving or dispersing the ingredients to form a coating composition that is applied to a support, which may have been provided first with an adhesive or subbing layer, and dried. Usually the layer is dried in air having a temperature of about 90° C. to about 130° C., preferably 100° C. to 120° C. depending upon the solvent used.

The dye layer thus formed has a thickness of about 0.2 to 5.0 μm, preferably 0.4 to 2.0 μm, and the amount ratio of dye or dye mixture to binder is between 9:1 and 1:3 by weight, preferably between 3:1 and 1:2 by weight.

The dye layer may further comprise thermal solvents.

Examples of such thermal solvents are the thermal solvents described in U.S. Pat. No. 3,438,776, DE 3339810, EP 119615, EP 327318 and further carboxylic acids and esters thereof such as glutaric acid, sebacic acid, citric acid or citric acid anhydride, ascorbic acid, benzoic acid, toluic acid, p-hydroxybenzoic acid, salicylic acid; fatty acids e.g. stearic acid, 12-hydroxystearic acid, methylstearate, biphenylsuberate; sulfonic acids such as benzenesulfonic acid, p-toluenesulfonic acid; alcohols such as 1-octadecanol, 1,6-hexanediol, 1,8-octanediol, 1,10-decanediol; sugars such as fructose, sorbitol; phenols and their derivatives such as resorcinol, α-naphthol, 2,3-dimethylphenol, p-decylphenol, p-methoxyphenol, p-(2-phenylethoxy)phenol; sulfonamides such as sulfamide, methylsulfonamide, N,N'-dicyclohexylsulfonamide; amides such as acetamide, N-methylacetamide, stearamide; imides such as succinimide, N-hydroxysuccinimide; amines such as α-napthylamine, triphenylamine; ureas such as urea, methylurea, N,N'-dimethylurea, N,N'-dicyclohexylurea, 1,3-dimethyl-2-imidazolidinone, N,N'-dimethyl-N,N'-propylene urea, thiourea, hydantoine; naphthalene derivatives such as 2-methoxynaphthalene; hydroquinone derivatives such as hydroquinone dichloromethylester, and diphenylcarbonate derivatives such as those mentioned in European Patent application no. 91202308.2.

Any dye can be used in the dye layer of the dye-donor element of the present invention provided it is transferable to the dye-receiving layer by the action of heat. Especially good results have been obtained with sublimable dyes such as described in EP 432829, EP 432313, EP 432314, EP 400706, EP 485665, EP 453020 and European patent application No. 91200218.5. In order to minimize catalytic fading of these dyes they can be used in combination with indoaniline dyes as described in e.g. U.S. Pat. No. 5,024,990 and U.S. Pat. No. 5,026,679.

The dye layer may also contain other additives, such as stabilizers, curing agents, preservatives, organic or inorganic fine particles, dispersing agents, antistatic agents, defoaming agents, viscosity controlling agents, etc., these and other ingredients being described more fully in EP 133011, EP 133012, EP 111004 and EP 279467.

Especially preferred organic fine particles for use in the dye layer are polyethylene, polypropylene and amide wax particles.

Any material can be used as the support for the dye-donor element provided it is dimensionally stable and capable of withstanding the temperatures involved, up to 400° C. over a period of up to 20 msec, and is yet thin enough to transmit heat applied on one side through to the dye on the other side to effect transfer to the receiver sheet within such short periods, typically from 1 to 10 msec. Such materials include polyesters such as polyethylene terephthalate, polyamides, polyacrylates, polycarbonates, cellulose esters, fluorinated polymers, polyethers, polyacetals, polyolefins, polyimides, glassine paper and condenser paper. Preference is given to a support comprising polyethylene terephthalate. In general, the support has a thickness of 2 to 30 μm.

Preferably, a subbing layer is provided between the dye layer and the support. Examples of suitable subbing layers are described, for example, in EP 433496, EP 311843, EP 268179, U.S. Pat. No. 4,717,057, U.S. Pat. No. 4,695,288 and in European Patent Application no. 92200907.1.

The other side of the dye-donor element is usually coated with a heat-resistant layer such as disclosed in e.g. EP 153880, EP 194106, EP 314348, EP 329117, JP 60/151096, JP 60/229787, JP 60/229792, JP 60/229795, JP 62/48589, JP 62/212192, JP 62/259889, JP 01/5884, JP 01/56587, JP 02/128899, JP 58/187396, JP 63/191678, JP 63/191679, JP 01/234292, JP 02/70485, and European patent application no. 91202071.6.

The use in the heat-resistant layer of at least one polycarbonate derived from a bis-(hydroxyphenyl)-cycloalkane as disclosed in the latter European patent application no. 91202071.6 is especially preferred for its high thermostability and ease of application.

Preferably, said bis-(hydroxyphenyl)-cycloalkane is 1,1 -bis-(4 -hydroxyphenyl )-3,3,5 -trimethylcyclohexane.

The heat-resistant layer of a dye-donor element may advantageously comprise a lubricant such as a surface-active agent, a liquid lubricant, a solid lubricant or mixtures thereof. Surface-active agents may be any agents known in the art such as carboxylates, sulfonates, phosphates, aliphatic amine salts, aliphatic quaternary ammonium salts, polyoxyethylene alkyl ethers, polyethylene glycol fatty acid esters, fluoroalkyl $C_2$–$C_{20}$ aliphatic acids. Examples of liquid lubricants include silicone oils, synthetic oils, saturated hydrocarbons and glycols. Examples of solid lubricants include various higher alcohols such as stearyl alcohol, fatty acids and fatty acid esters, talc, teflon beads, and silica particles.

Preferred lubricants are polysiloxane-polyether copolymers and glycerol monostearate used alone or in combination with each other. Other lubricants have been described in e.g. U.S. Pat. No. 4,753,921, U.S. Pat. No. 4,916,112, U.S. Pat. No. 4,717,711, U.S. Pat. No. 4,717,712, U.S. Pat. No. 4,866,026 and U.S. Pat. No. 4,829,050. The amount of lubricant used in the heat-resistant layer depends largely on the type of lubricant, but is generally in the range of from about 0.1 to 50 wt %, preferably 0.5 to 40 wt % of the binder or binder mixture employed.

As mentioned above the lubricants can be incorporated into the heat-resistant layer. Advantageously, however, a separate top layer comprising at least one lubricant is coated on top of the heat-resistant layer. Preferably, a top layer of a polyether-polysiloxane copolymer, optionally in combination with glycerol monostearate, is coated from a non-solvent for the heat-resistant layer on the latter layer. Another preferred separate top layer comprising lubricants has been described in European Patent Application no. 92200229.0.

The heat-resistant layer of the dye-donor element of the present invention may contain other additives provided such materials do not impair the anti-stick properties of the heat-resistant layer and provided that such materials do not scratch, erode, contaminate, or otherwise damage the thermal printing head or harm the image quality. Examples of suitable additives have been described in EP 389153.

The heat-resistant layer of the dye-donor element of the present invention is formed preferably by adding the polymeric thermoplastic binder or binder mixture, the lubricant(s), and other optional components to a suitable solvent or solvent mixture, dissolving or dispersing the ingredients to form a coating composition, applying the coating composition to a support, which may first have been provided with a layer, and dried.

The heat-resistant layer of the dye-donor element may be coated on the support or printed thereon by a printing technique such as a gravure process.

The heat-resistant layer thus formed has a thickness of about 0.1 to 3 μm, preferably 0.3 to 1.5 μm.

In order to enhance the adhesion between the support and the heat-resistant layer, a subbing layer is advantageously used, applied between the support and the heat-resistant layer.

As subbing layer any of the subbing layers known in the art for dye-donor elements can be used. Suitable binders that can be used for the layer can be chosen from the classes of polyester resins, polyurethane resins, polyester urethane resins, modified dextrans, modified cellulose, and copolymers comprising recurring units such as i.a. vinylchloride, vinylidenechloride, vinylacetate, acrylonitrile, methacrylate, acrylate, butadiene, and styrene (e.g. poly(vinylidenechloride-co-acrylonitrile)). Suitable layers are described in e.g. EP 138483, EP 227090, U.S. Pat. No. 4,567,113, U.S. Pat. No. 4,572,860, U.S. Pat. No. 4,717,711, U.S. Pat. No. 4,559,273, U.S. Pat. No. 4,695,288, U.S. Pat. No. 4,727,057, U.S. Pat. No. 4,737,486, U.S. Pat. No. 4,965,239, U.S. Pat. No. 4,753,921, U.S. Pat. No. 4,895,830, U.S. Pat. No. 4,929,592, U.S. Pat. No. 4,748,150, U.S. Pat. No. 4,965,238 and U.S. Pat. No. 4,965,241. Preferably the subbing layer further comprises an aromatic polyol such as 1,2-dihydroxybenzene as described in EP 433496. Especially preferred are subbing layers such as those described in European Patent Application No. 92200907.1.

The support for the receiver sheet used in combination with the present dye-donor element may be a transparent film of e.g. polyethylene terephthalate, a polyether sulfone, a polyimide, a cellulose ester, or a polyvinyl alcohol-co-acetal. The support may also be a reflective one such as baryta-coated paper, polyethylene-coated paper, or white polyester i.e. white-pigmented polyester. Blue-colored polyethylene terephthalate film can also be used as a support.

To avoid poor adsorption of the transferred dye to the support of the receiver sheet this support should be coated with a special coating, called dye-receiving layer. This layer may comprise e.g. a polycarbonate, a polyurethane, a polyester, a polyamide, polyvinyl chloride, poly(styrene-co-acrylonitrile), and polycaprolacton or mixtures thereof. Suitable dye-receiving layers have been described in e.g. EP 133011, EP 133012, EP 144247, EP 227094, EP 228066. The dye-receiving layer may also comprise a cured binder such as the heat-cured product of poly(vinylchloride-co-vinyl acetate-co-vinyl alcohol) and polyisocyanate.

In order to improve the light resistance and other stabilities of recorded images, UV absorbers, singlet oxygen quenchers such as HALS-compounds (Hindered Amine Light Stabilizers) and/or antioxidants can be incorporated into the dye-receiving layer.

The dye layer of the dye-donor element and/or the dye-receiving layer of the receiver sheet may also contain a releasing agent that aids in separating the dye-donor element from the receiver sheet after transfer. The releasing agents can also be provided in a separate layer on at least part of the dye layer or of the dye-receiving layer. Solid waxes, fluorine- or phosphate-containing surfactants and silicone oils can be used as releasing agent. Suitable releasing agents have been described in e.g. EP 133012, JP 85/19138, and EP 227092.

The thermal dye sublimation transfer printing process comprises placing the dye layer of the donor element in face-to-face relation with the dye-receiving layer of the receiver sheet and image-wise heating from the back of the dye-donor element. The transfer of the dye is accomplished by heating for several milliseconds at about 400° C.

When the process is performed for but one single colour, a monochrome dye transfer image is obtained. A multicolour image can be obtained by using a dye-donor element containing three or more primary colour dyes and sequentially performing the process steps described above for each colour. The above sandwich of dye-donor element and receiver sheet is formed on three occasions during the time when heat is applied by the thermal printing head. After the first dye has been transferred, the elements are peeled apart. A second dye-donor element (or another area of the dye-donor element with a different dye area) is then brought in register with the receiving sheet and the process is repeated. The third colour and optionally further colours are obtained in the same manner.

In addition to thermal printing heads, laser light, infrared flash, or heated pens can be used as the heat source for supplying heat energy. Thermal printing heads that can be used to transfer dye from the dye-donor elements of the present invention to a receiver sheet are commercially available. In case laser light is used, the dye layer or another layer of the dye donor-element should contain a compound e.g. carbon black that absorbs the light emitted by the laser and converts it into heat.

Alternatively, the support of the dye-donor element may be an electrically resistive ribbon consisting of e.g. a multilayer structure of a carbon-loaded polycarbonate coated with a thin aluminium film. Current is injected into the resistive ribbon by electrically addressing a print head electrode resulting in highly localized heating of the ribbon beneath the relevant electrode. The fact that in this case the heat is generated directly in the resistive ribbon and that it is thus the ribbon that gets hot leads to an inherent advantage in printing speed using the resistive ribbon/electrode head technology as compared to the thermal head technology, in which latter case the various elements of the thermal printing head get hot and must cool down before the head can move to the next printing position.

The following examples illustrate the invention in more detail without, however, limiting the scope thereof.

EXAMPLE 1: Monochrome dye (mixtures)

A dye-donor element for use according to thermal dye sublimation transfer was prepared as follows:

A solution comprising the dye or dye mixture, Ketjenflex MH and the polymeric binder in methylethylketone as solvent was prepared. The amount of dyes, Ketjenflex MH and binder is indicated in Table 1. The percentages are weight percentages in the coating solution. From this solution a layer having a wet thickness of 10 μm was coated on 6 μm thick polyethylene terephthalate film, provided with a conventional subbing layer. The resulting layer was dried by evaporation of the solvent.

The opposite side of the film support was coated with a subbing layer of a copolyester comprising ethylene glycol, adipic acid, neopentyl glycol, terephthalic acid, isophthalic acid and glycerol. On top of this subbing layer, a heat-resistant layer was casted from methylethylketone, containing 0.5 g/m² of a polycarbonate having the following structure:

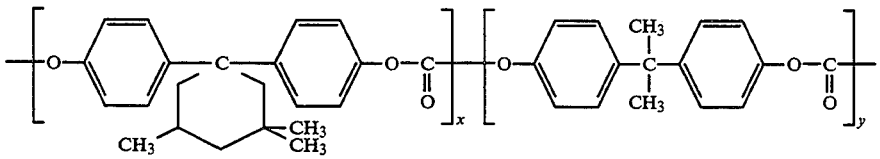

wherein x=55 mol % and y=45 mol %.

On top of said polycarbonate layer, a topcoat layer of polyether modified polydimethylsiloxane (Tegoglide 410, Goldschmidt) was applied from isopropanol.

A receiving sheet was prepared by coating a dye-receiving layer containing 3.6 g/m² of poly(vinyl chloride-co-vinyl acetate-co-vinyl alcohol) (VINYLITE VAGD sold by UNION CARBIDE), 0.336 g/m² of diisocyanate (DESMODUR VL sold by BAYER AG), and 0.2 g/m² of hydroxy-modified polymethyl siloxane (TEGOMER H SI 2111 sold by TH. GOLDSCHMIDT AG) on a 175 μm thick polyethylene terephthalate film support.

The dye-donor element was printed in combination with the receiving sheet in a Mitsubishi colour video printer CP100E.

The density of the printed image was measured in transmission in a Macbeth TR924 densitometer (status A).

The experiment was repeated for all dyes, dye mixtures and binder mixtures indicated in Table 1.

The resulting donor ribbons were submitted to a stability test (45° C., 7 days).

TABLE 1

| Example | Dye Type | Dye Concentration | Polymeric binder Type | Polymeric binder Concentration | Ketjenflex MH Concentration | Density |
|---|---|---|---|---|---|---|
| 1 (COMP) | D1 | 12 | B1 | 10 | 0 | 1.56 |
| 2 | D1 | 12 | B1 | 9 | 1 | 1.68 |
| 3 | D1 | 12 | B1 | 8 | 2 | 1.93 |
| 4 (COMP) | D2 | 10 | B1 | 10 | 0 | 1.50 |
| 5 | D2 | 10 | B1 | 9 | 1 | 1.70 |
| 6 | D2 | 10 | B1 | 8 | 2 | 1.79 |
| 7 | D2 | 10 | B1 | 7 | 3 | 1.73 |
| 8 | D2 | 10 | B1 | 6 | 4 | 1.96 |
| 9 | D2 | 10 | B1 | 5 | 5 | 2.08 |
| 10 (COMP) | D1<br>D3 | 6<br>6 | B1 | 10 | 0 | 1.96 |
| 11 | D1<br>D3 | 6<br>6 | B1 | 9 | 1 | 2.19 |
| 12 | D1<br>D3 | 6<br>6 | B1 | 8 | 2 | 2.32 |
| 13 (COMP) | D1 | 10 | B2 | 10 | 0 | 1.32 |
| 14 | D1 | 10 | B2 | 8 | 2 | 1.64 |
| 15 | D1 | 10 | B2 | 5 | 5 | 2.36 |
| 16 (COMP) | D1 | 10 | B3 | 10 | 0 | 2.30 |
| 17 | D1 | 10 | B3 | 8 | 2 | 2.51 |
| 18 | D1 | 10 | B3 | 5 | 5 | 2.76 |

D1

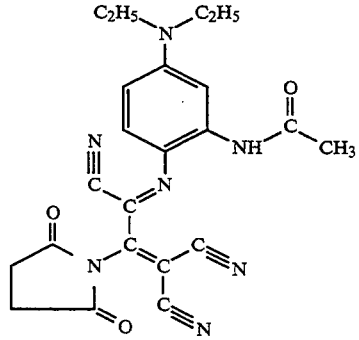

D2

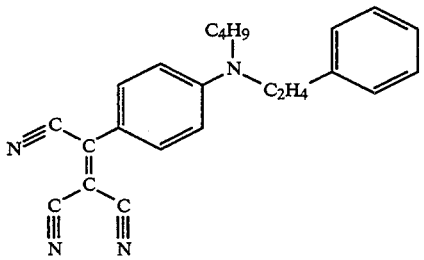

D3

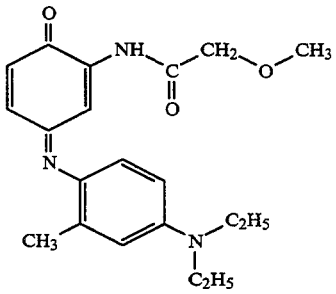

Luran 388S (BASF, Germany) B1
Cellulose acetate butyrate (29 wt. % acetyl, 17 wt % butyryl) B2
Polyvinylbutyral (71 wt % vinylbutyral, 29 wt % vinylalcohol) B3

It can be seen from table 1 that the donor elements of the present invention exhibit a higher dye transfer efficiency than conventional dye-donor elements known in the art (comparative examples 1, 4, 10, 13 and 16). Moreover, when the dye-donor elements of the present invention were stored in rolled form at 45° C., no crystallization of the dye (mixture) was observed and no sticking occured between the dye-layer and the heat-resistant layer.

Higher concentrations of Ketjenflex MH (above 50% of the total amount of binder) result in donor elements with low stability in rolled form.

EXAMPLE 2: Black dye mixtures

A dye-donor element was prepared as in example 1, except that the following dye mixture was used: 2.4% of dye D3, 8% of dye D4 and 6.4% of dye D5. The results are given in table 2.

TABLE 2

D4

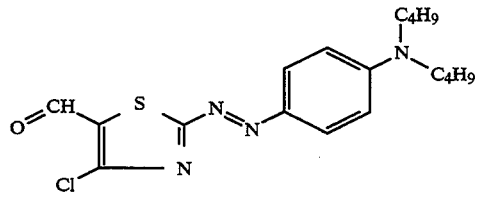

D5

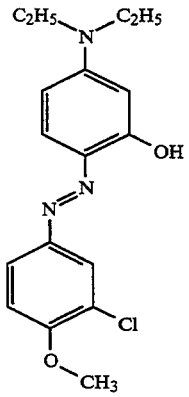

| Example Nr. | Polymeric binder Type | Concen-tration | Ketjen-flex MH Concen-tration | Density Visual | Red | Green | Blue |
|---|---|---|---|---|---|---|---|
| 19 (COMP) | B1 | 8 | 0 | 1.35 | 1.35 | 1.17 | 1.20 |
| 20 | B1 | 7 | 1 | 1.44 | 1.45 | 1.25 | 1.30 |
| 21 | B1 | 6 | 2 | 1.48 | 1.50 | 1.30 | 1.30 |

It can be concluded from table 2 that black dye-donor elements of the present invention exhibit a higher dye transfer efficiency. The stability of the dye-donor elements of the present invention in rolled form is not affected by the addition of Ketjenflex MH.

We claim:

1. Dye-donor element for use according to thermal dye sublimation transfer comprising a support having on one side thereof a dye layer, characterized in that said dye layer or a layer adjacent to said dye layer contains a toluene sulfonamide formaldehyde condensation product.

2. Dye-donor element according to claim 1, wherein said toluene sulfonamide formaldehyde condensation product is contained in the dye layer.

3. Dye-donor element according to claim 1 or 2, wherein said layer further comprises at least one polymeric binder other than said toluene sulfonamide formaldehyde condensation product.

4. Dye-donor element according to claim 3, wherein said polymeric binder is selected from the group of cellulose esters, poly(styrene-co-acrylonitrile), polyvinylacetal and polyvinylbutyral.

5. Dye-donor element according to claim 3 or 4, wherein the ratio of polymeric binder to toluene sulfonamide formaldehyde condensation product is between 0.5 and 20.

6. Dye-donor element according to claim 1, wherein said dye layer further comprises polyethylene particles, polypropylene particles or amide wax particles.

7. Dye-donor element according to claim 1, wherein a subbing layer has been applied between said support and said dye layer.

8. Dye-donor element according to claim 1, wherein said dye-donor element further comprises a heat-resistant layer on the side of the support opposite to said dye layer.

9. Dye-donor element according to claim 8, wherein said heat-resistant layer comprises at least one polycarbonate derived from 1,1-bis-(4-hydroxyphenyl)-3,3,5-trimethylcyclohexane.

10. Dye-donor element according to claim 8 or 9, wherein a separate top layer comprising at least one lubricant has been coated on top of said heat-resistant layer.

11. Thermal sublimation transfer process comprising the steps of:

placing a dye layer on the support of a dye donor element in face to face contact with a dye receiving layer of a receiver sheet and image-wise heating said dye donor element from its back characterized in that said dye layer or a layer of said dye donor element adjacent thereto contains a toluene sulfonamide formaldehyde condensation product.

* * * * *